US007021525B2

(12) United States Patent
Jouppi et al.

(10) Patent No.: US 7,021,525 B2
(45) Date of Patent: Apr. 4, 2006

(54) RECLOSEABLE CARTON

(75) Inventors: Patrick T. Jouppi, Albuquerque, NM (US); Stephen J. Surmik, Covington, GA (US)

(73) Assignee: General Mills, Inc., Minneapolis, MN (US)

( * ) Notice: Subject to any disclaimer, the term of this patent is extended or adjusted under 35 U.S.C. 154(b) by 150 days.

(21) Appl. No.: 10/656,844

(22) Filed: Sep. 5, 2003

(65) Prior Publication Data

US 2005/0051612 A1 Mar. 10, 2005

(51) Int. Cl.
*B65D 5/10* (2006.01)
*B65D 5/20* (2006.01)

(52) U.S. Cl. ..... 229/155; 229/149

(58) Field of Classification Search ..... 229/155, 229/158, 148, 149
See application file for complete search history.

(56) References Cited

U.S. PATENT DOCUMENTS 281,354 A * 7/1883 Edwards ..... 229/155
889,109 A * 5/1908 Davidson ..... 229/155
2,492,454 A * 12/1949 Anderson, Jr. ..... 229/148
4,049,190 A * 9/1977 O'Neill ..... 229/149
5,431,333 A * 7/1995 Lorenz ..... 229/149
6,676,010 B1 * 1/2004 Roseth et al. ..... 229/148

FOREIGN PATENT DOCUMENTS

DE 2703432 A1 * 8/1977 ..... 229/155
DE 3834083 C1 * 9/1989 ..... 229/155

* cited by examiner

*Primary Examiner*—Gary E. Elkins
(74) *Attorney, Agent, or Firm*—John A. O'Toole; Timothy A. Czaja; Douglas J. Taylor

(57) ABSTRACT

A blank for forming a carton. The blank includes a first major panel, a second major panel, a first minor panel, a first closure flap, and a second closure flap. The first minor panel is connected between the first and second major panels. The first closure flap is connected to a first end of the first major panel and extends therefrom to a leading edge. The first closure flap includes a central region forming a tuck slot that is open relative to the leading edge. The second closure flap extends from a first end of the second major panel and forms a tab. The tuck slot is adapted to selectively receive the tab in a carton formed by the blank.

27 Claims, 5 Drawing Sheets

RECLOSEABLE CARTON

BACKGROUND

The present invention relates to a recloseable carton. More particularly, it relates to a carton having an improved tuck slot reclosure configuration that eliminates the frustrations associated with conventional perforated tuck slots.

The packaging of consumer foods and other products has long required a suitable container for consumer use that is easy to open as well as being capable of reclosure. To this end, containers, including paperboard cartons or boxes, have been used for many years to transport and store individual packaged products, including, for example, packaged food products such as cereals, snack foods, dried fruit products, etc. Often times, to maintain product freshness, the product is contained within a sealed bag(s) that is otherwise placed within the paperboard carton. Even with this construction, however, the paperboard carton must be opened to access the contained bag(s). Regardless, consumers strongly desire the ability to reclose the carton to prevent product spillage and potentially maintain product freshness.

In light of the above, conventional cartons are generally square or rectangular in shape, having front and back walls, opposing side walls, a bottom closure, and a top closure. With some constructions, the bottom closure is defined by two or more overlapping flaps extending from the front and back walls; alternatively, a single panel defines the bottom closure. Regardless, the top closure is formed by a first closure flap connected to the front wall and a second closure flap connected to the back wall. Additional dust or minor flaps may also be provided. Nonetheless, the first closure flap forms a tab, whereas the second closure flap forms a tuck slot. More particularly, the tuck slot is formed by a perforation cut at an interior of the second closure flap. As initially presented to the consumer (i.e., as sold by a retailer), the tuck slot is effectively only partially formed via the perforation cut. Further, the first closure flap is glued or otherwise adhered over the second closure flap. To access the contained product, the consumer must separate or otherwise release the second closure flap from the first closure flap. A desired quantity of the contained product can then be dispensed (if necessary, the interior carton liner or bag may also require opening). The carton is then reclosed by the consumer by first physically pushing through the tuck slot perforations to complete the tuck slot. Once the tuck slot is formed, the second closure flap is folded onto the first closure flap and the first closure flap is manipulated to insert the tab within the tuck slot.

While the above-described tuck slot and tab configuration is widely employed, several potential drawbacks exist. For example, consumers often find it difficult to physically push through the perforation cut to properly "complete" the tuck slot. Because the perforation cut/tuck slot area is relatively small, the physical force necessary to push through the perforations often results in tearing of the closure flap in a region of the tuck slot, rendering the tuck slot incapable of retaining the tuck tab. Additionally, the perforation cut may undesirably tear as the consumer is initially separating the glued first and second closure flaps, again leading to problems in successfully reclosing the carton. Also, even if properly formed, the conventional tuck slot has an extremely small width (commensurate with a width or diameter of the perforations), rendering insertion of the tab within the so-formed tuck slot quite difficult. From a manufacturer's standpoint, alleviating any source of potential consumer frustration is highly desirable.

Cartons continue to be a highly popular format for packaging and selling products to consumers. Unfortunately, current carton designs, and in particular the perforation cut/tuck slot and tab design, is less than optimal. Therefore, a need exists for a carton and related blank adapted to promote easy and consistent reclosure thereof by a consumer.

SUMMARY

One aspect of the present invention relates to a blank for forming a carton. The blank includes a first major panel, a second major panel, a first minor panel, a first closure flap, and a second closure flap. The first minor panel is connected between the first and second major panels. The first closure flap is connected to a first end of the first major panel and extends therefrom to a leading edge. In this regard, the first closure flap includes a central region forming a tuck slot that is open relative to the leading edge. The second closure flap extends from a first end of the second major panel and forms a tab. With this in mind, the tuck slot is adapted to selectively receive the tab in a carton formed by the blank. In one embodiment, at least a central region of the first closure flap is characterized by the absence of a perforation cut. In another embodiment, the tuck slot includes first, second, and third sections, with the first and third sections extending from the second section, respectively, in an angular fashion.

Another aspect of the present invention relates to a carton including a front wall, a back wall, opposing side walls, a bottom closure, and a top closure. The opposing side walls connect opposite sides of the front and back walls, respectively, to define a tubular structure having a top and a bottom. The bottom closure is provided at the bottom of the tubular structure. Conversely, the top closure is provided at the top of the tubular structure. In this regard, the top closure includes a first closure flap and a second closure flap. The first closure flap extends to a leading edge and includes a central region forming a tuck slot that is open relative to the leading edge. The second closure flap forms a tab. With this in mind, the top closure is configured such that the tuck slot selectively receives the tuck tab as part of a reclosure operation. In one embodiment, at least the central region of the first closure flap is characterized by the absence of a perforation cut.

Yet another aspect of the present invention relates to a method of forming a carton. The method includes creating a blank having first and second major panels, at least one minor panel, a first closure flap including a central region forming a tuck slot that is open relative to a leading edge thereof, a second closure flap forming a tab, and a plurality of fold lines. The blank is folded along the plurality of fold lines to form a front wall, a back wall, at least first and second side walls, a bottom closure, and a top closure. In this regard, the top closure includes the first and second closure flaps. The second closure flap is glued over the first closure flap such that the second closure flap covers the tuck slot. With this in mind, the top closure is transitionable to an open state, whereby the second closure flap is released from the first closure flap and then subsequently to a reclosed state in which the tab is received within the tuck slot.

DETAILED DESCRIPTION

In the following Detailed Description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments of the present invention can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
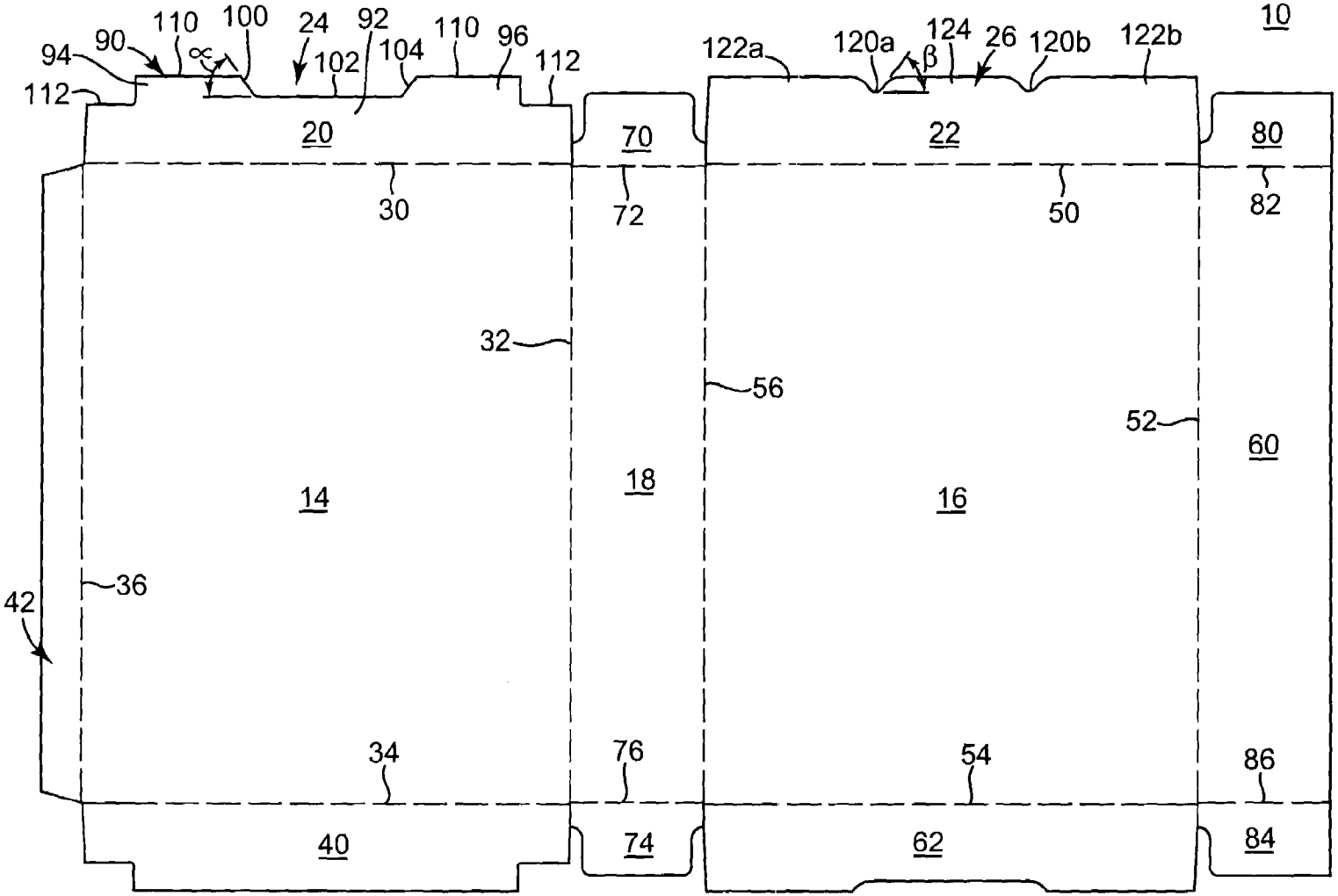
FIG. 1 is a plan view of a blank for forming a carton in accordance with the present invention.

A carton blank 10 for forming a carton 12 (FIG. 2) in accordance with the present invention is provided in FIG. 1. The blank 10 can be made from a paperboard material or other material conventionally used in carton formation. The blank 10 includes or defines a first major panel 14, a second major panel 16, a first minor panel 18, a first closure flap 20, and a second closure flap 22. These components, along with other panels and flaps associated with the one embodiment blank 10 of FIG. 1 are described in greater detail below. In general terms, however, the first minor panel 18 is connected between the first and second major panels 14, 16. The first closure flap 20 extends from the first major panel 14 and forms a tuck slot 24 that is otherwise open relative to a leading edge thereof. The second closure flap 22 extends from the second major panel 16 and forms a tab 26. Upon final assembly, the tuck slot 24 is adapted to selectively receive the tab 26 as part of a reclosure operation.

The first major panel 14 is, in one embodiment, rectangularly shaped, generally defined by first, second, third, and fourth ends 30–36. Each of the ends 30–36 are designated in FIG. 1 by dashes that otherwise represent a fold line. The fold lines are preferably defined by, but not limited to, crimping, some form of marking or some other line-forming process, or adjacent elements of the blank 10 having a common edge. Alternatively, a partial-cut score line (e.g., cut to a depth of approximately 50% of the thickness of the paperboard material) can be employed to define one or more of the ends 30–36. As used throughout the specification, the terms "fold" or "fold line" encompasses any known technique for demarcating one panel/flap from an adjacent panel/flap in a manner that facilitates folding of the two components relative to one another. With this designation in mind, the first closure flap 20 extends from the first end 30, whereas the first minor panel 18 extends from the second end 32. Additionally, a third closure flap 40 extends from the third end 34 and a glue flap 42 extends from the fourth end 36. The third closure flap 40 and the glue flap 42 can assume a variety of forms appropriate for forming the blank 10 as a carton.

The second major panel 16 is preferably identical in shape and size to the first major panel 14, and is defined by first, second, third, and fourth ends or fold lines 50–56. The second closure flap 22 extends from the first end 50, whereas the first minor panel 18 is connected to the fourth end 56. Additionally, with the one embodiment of FIG. 1, a second minor panel 60 extends from the second end 52 and a fourth closure flap 62 extends from the third end 54. Once again, the second minor panel 60 and the fourth closure flap 62 can assume a wide variety of forms appropriate for forming the blank 10 as a carton. Regardless, with the one embodiment of FIG. 1, the first end or fold line 30 of the first major panel 14 is generally aligned with the first end or fold line 50 of the second major panel 16 in a plane of the blank 10.

The first minor panel 18 is positioned between the first and second major panels 14, 16. In one embodiment, a first partial or dust flap 70 extends from a first end or fold line 72 of the first minor panel 18 and a second partial or dust flap 74 extends from a second end or fold line 76. Once again, the first and second partial flaps 70, 74 are foldable relative to the first minor panel 18. Full cuts (i.e., cuts that extend through the entire thickness of the paperboard material) laterally separate the first partial flap 70 from the first and second closure flaps 20, 22, as well as the second partial flap 74 from the third and fourth closure flaps 40, 62, to allow each panel or flap to be freely folded inward. Similarly, a third partial or dust flap 80 extends from a first end or fold line of the second minor panel 60 and a fourth partial or dust flap 84 extends from a second end or fold line 86. The third and fourth partial flaps 80, 84 can assume a variety of forms, and are separated from the second and fourth closure flaps 22, 62, respectively, by full cuts.

As previously described, the first closure flap 20 forms the tuck slot 24. In particular, the first closure flap 20 extends from the first end or fold line 30 of the first major panel 14 to a leading edge 90. The first closure flap 20 is generally defined by a central region 92, a first side region 94, and a second side region 96, with the side regions 94, 96 being positioned at opposite sides of the central region 92. In this regard, the central region 92 forms the tuck slot 14 as an inward extension of the leading edge 90 from the first and second side regions 94, 96 toward the first end 30 of the first major panel 14. That is to say, the leading edge 90 is recessed in the central region 92 as compared to the first and second side regions 94, 96 immediately adjacent thereto. In one embodiment, the leading edge 90 along at least the tuck slot 24 is not formed by a perforation cut (i.e., is instead formed by a full cut), with the central region 92 being entirely void of any perforation cuts. As a point of reference, a perforation or perforation cut is a paperboard cut that intermittently cuts through the entire thickness of the paperboard material while leaving intermittent pieces of the paperboard material attached.

In one embodiment, the leading edge 90 defines the tuck slot 24 to have a first section 100, a second section 102, and a third section 104. The first section 100 extends between the first side region 94 and the second section 102, whereas the third section 104 extends between the second section 102 and the second side region 96. In this regard, extension of the first section 100 relative to the second section 102 preferably mirrors extension of the third section 104 relative to the second section 102, with each extension defining a taper angle $\alpha$ of at least 30°, more preferably in the range of 40°–70°, even more preferably approximately 51°. With the one embodiment of FIG. 1, the leading edge 90 at the first and second side regions 94, 96 includes a main portion 110 and a recessed portion 112. The recessed portion 112 is offset from the main portion 110 opposite the central region 92. Alternatively, the recessed portion 112 can be eliminated such that the leading edge 90 is linear (in a plane perpendicular to the plane of FIG. 1) along an entirety of each of the first and second side regions 94, 96. Regardless, the leading edge 90 at each of the main portions 110 is aligned; whereas the second section 102 of the tuck slot 24 is offset from the main portions 110 in a plane of the blank 10. Preferably, however, extension of the leading edge 90 along the second section 102 is substantially parallel with the extension of the leading edge 90 along each of the main portions 110.

In one embodiment, the tuck slot 24 has a longitudinal width (i.e., longitudinal distance between the second section 102 and either of the main portions 110) of at least 0.125 inch (3.175 ml), and more preferably at least 0.1875 inch (4.763 mm), and even more preferably at least 0.25 inch (6.35 mm). It has surprisingly been found that by providing the tuck slot 24 with this relatively large longitudinal width, insertion and retention of the tab 26 can readily be achieved as described in greater detail below. Further, the tuck slot 24 has a lateral length (i.e., maximum lateral distance between the first and third sections 100, 104) of at least 1 inch (25 mm), more preferably, at least 1.5 inches (38 mm), and even more preferably, at least 2.5 inches (63 mm). With these parameters in mind, then, the tuck slot 24 is defined by an open area of at least 0.125 $inch^2$ (80.64 $mm^2$), more preferably at least 0.5 $inch^2$ (322.6 $mm^2$), and even more preferably at least 0.625 $inch^2$ (403.2 $mm^2$). Once again, it has surprisingly been found that by forming the tuck slot 24 to be open, and to provide a relatively large open area, facilitates quick and consistent insertion and removal of the tab 26 within the tuck slot 24.

As previously described, the second closure flap 22 defines the tab 26. To this end, the tab 26 can assume a variety of shapes and sizes, but is preferably defined by cutouts 120*a*, 120*b* at opposites sides thereof. With this one configuration, the tab 26 includes opposing side portions 122*a*, 122*b* and a central portion 124. The opposing side portions 122*a*, 122*b* extend in an angular fashion from the central portion 124, defining a taper angle $\beta$ in the range of 25°–65°, more preferably 35°–55°, even more preferably approximately 45°. Further, the tab 26 preferably has a maximum lateral length (i.e., distance between the opposing side portions 122*a*, 122*b*) of at least 1 inch (25.4 mm). More preferably at least 1.5 inches (38 mm), and even more preferably at least 2 inches (51 mm). To this end, the maximum length of the tuck slot 24, as previously described, is slightly greater than that of the tab 26 so as to facilitate insertion of the tab 26 within the tuck slot 24. Similarly, the taper angle $\alpha$ defined by the first and second sections 102, relative to the first section 100 of the leading edge 90 of the tuck slot 24 is preferably greater than the taper angle $\beta$ previously described, again to facilitate insertion of the tab 26. Alternatively, a wide variety of other constructions for the tab 26 are equally acceptable.

Assembly of the exemplary blank 10 into the carton 12 (FIG. 2) is substantially as follows. The first and second major panels 14, 16 are folded toward one another relative to the first minor panel 18, along the second fold line 32 and the fourth fold line 56, respectively. The glue flap 42 is folded inwardly relative to the first major panel 14 along the fourth fold line 36. The second minor panel 60 is folded inwardly along the second fold line 52 on to the glue flap 42 and then adhered thereto (via an adhesive previously applied to the glue flap 42). The second partial flap 74 and the fourth partial flap 84 are folded inwardly, followed by the third closure flap 40 and the fourth closure flap 62. In this regard, the fourth closure flap 62 is glued to the third closure flap 40, such as by an adhesive previously applied to at least a portion of the third closure flap 40. At this point, product(s) (not shown) can be placed into the partially formed carton before closing the first and second closure flaps 20, 22. After filling, the first and third partial flaps 70, 80 are folded inwardly, followed by the first closure flap 20 and the second closure flap 22. The second closure flap 22 is glued to the first closure flap 20, such as by an adhesive applied to at least a portion of the first closure flap 20. Alternatively, the first and second closure flaps 20, 22 can be closed, followed by desired product filling, prior to closing the third and fourth closure flaps 40, 62.

Figure 2:
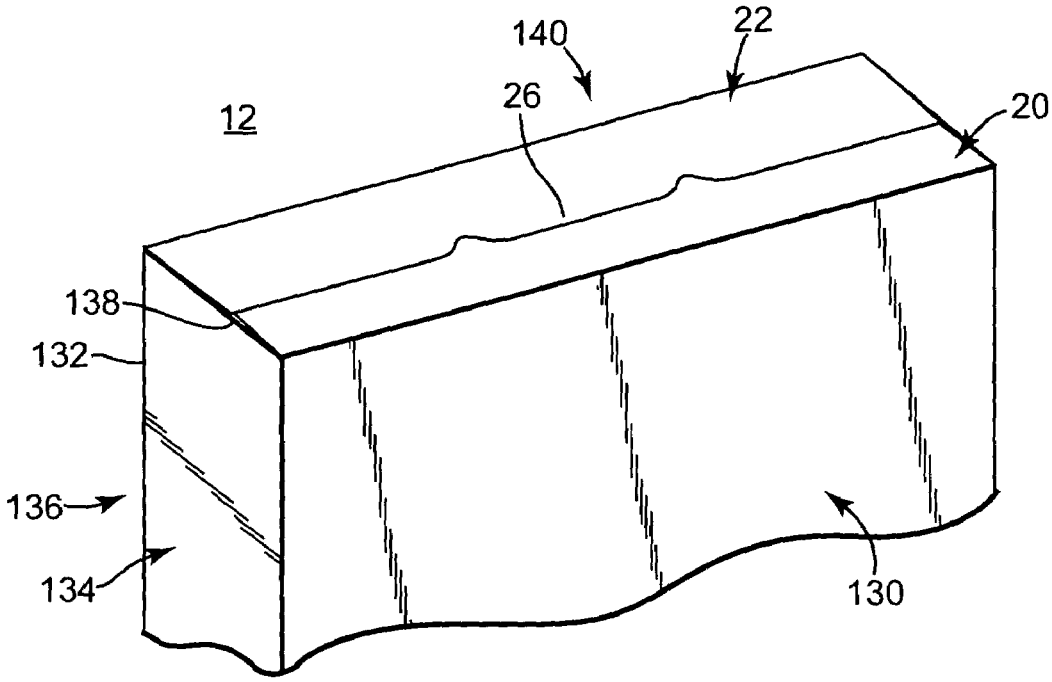
FIG. 2 is a top, partial perspective view of a formed and sealed carton formed from the blank of FIG. 1.

The resulting carton 12 is shown in FIG. 2. As a point of reference, the carton 12 is illustrated in FIG. 12 in a final assembled state (i.e., prior to opening by a user). With this in mind, the carton 12 includes a front wall 130, a back wall 132 (hidden in the view of FIG. 2, but referenced generally), and opposing side walls 134 (one of which is shown in FIG. 2). As a point of reference, with the one exemplary embodiment of FIGS. 1 and 2, the front wall 130 corresponds with the first major panel 14 (FIG. 1), the back wall 132 corresponds with the second major panel 16 (FIG. 1), and the opposing side walls 134 correspond with the first and second minor panels 18, 60 (FIG. 1). Alternatively, the walls 130–134 can be formed by a variety of different configurations, including two or more panels/flaps (e.g., the front wall 130, and the back wall 132 and/or one or both of the side walls 134 can each or all be defined by two or more overlapping layers of paperboard material in the form of panels and/or flaps). Further, the carton 12 can include additional walls.

Regardless, the resultant wall construction defines a tubular structure 136 (referenced generally in FIG. 2) having a top 138 (referenced generally in FIG. 2) and a bottom (not shown). The bottom is encompassed by a bottom closure (not shown), that, in one embodiment, consists of the adhered third and fourth closure flaps 40, 62 (FIG. 1) that otherwise cover the second and fourth partial or dust flaps 74, 84 (FIG. 1). Conversely, the top 138 is encompassed by a top closure 140. With the one embodiment of the FIGS. 1 and 2, the top closure 140 includes the first closure flap 20 and the second closure flap 22. Once again, the top closure 140 can assume a variety of different forms, but includes the tab 26 and the tuck slot 24 (covered by the second closure flap 22 in the view of FIG. 2, but shown in FIG. 1). Notably, while the first closure flap 20 (that otherwise forms the tuck slot 24) is shown in FIG. 2 as being connected to, and extending from the front wall 130 and the second closure flap 22 is connected to, and extends from, the back wall 132 (referenced generally), this construction can be reversed such that the tab-forming closure flap extends from the front wall 130 and the tuck slot-forming flap extends from the back wall 132.

Though not shown in FIG. 2, a variety of products can be contained within the carton 12. Further, additional packaging can be included, such as a sealed bag that is otherwise disposed within the carton 12.

Figure 3:
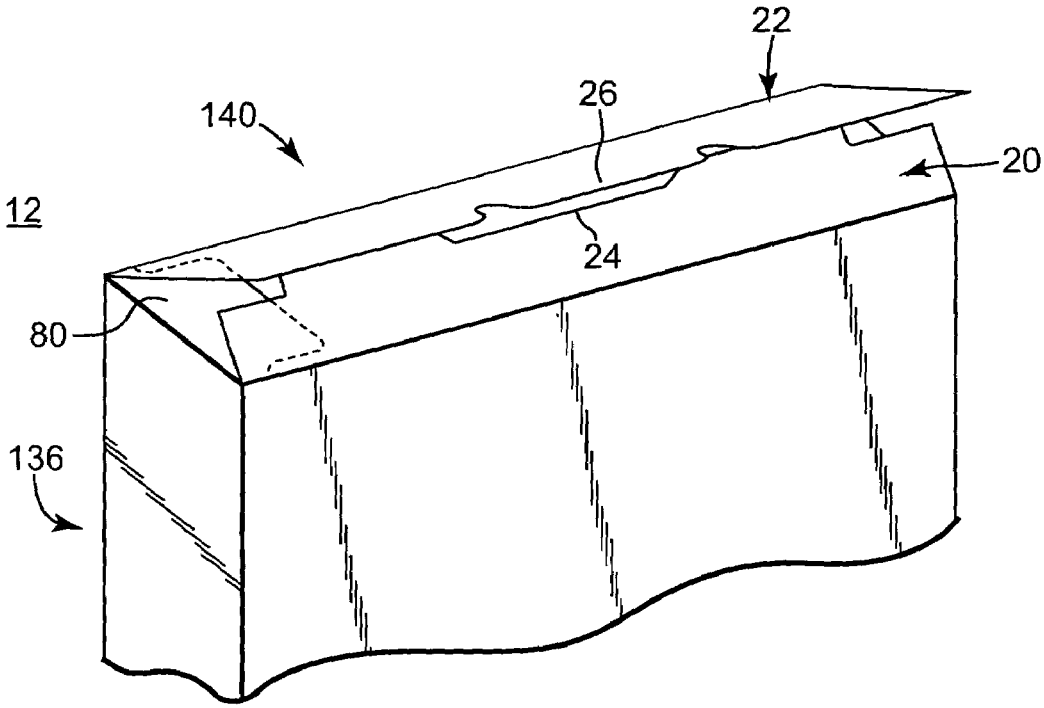
FIG. 3 is a partial perspective view of the carton of FIG. 2, illustrating the closure flaps in a partially-opened position.

FIG. 3 illustrates the carton 12 in a partially open state. In particular, the top closure 140 is opened, such as by releasing the second closure flap 22 from the first closure flap 20, and unfolding the flaps 20, 22 relative to one another. With the view of FIG. 3, the tuck slot 24 and the tab 26 are more clearly shown, as is the third partial flap 80.

Figure 4:
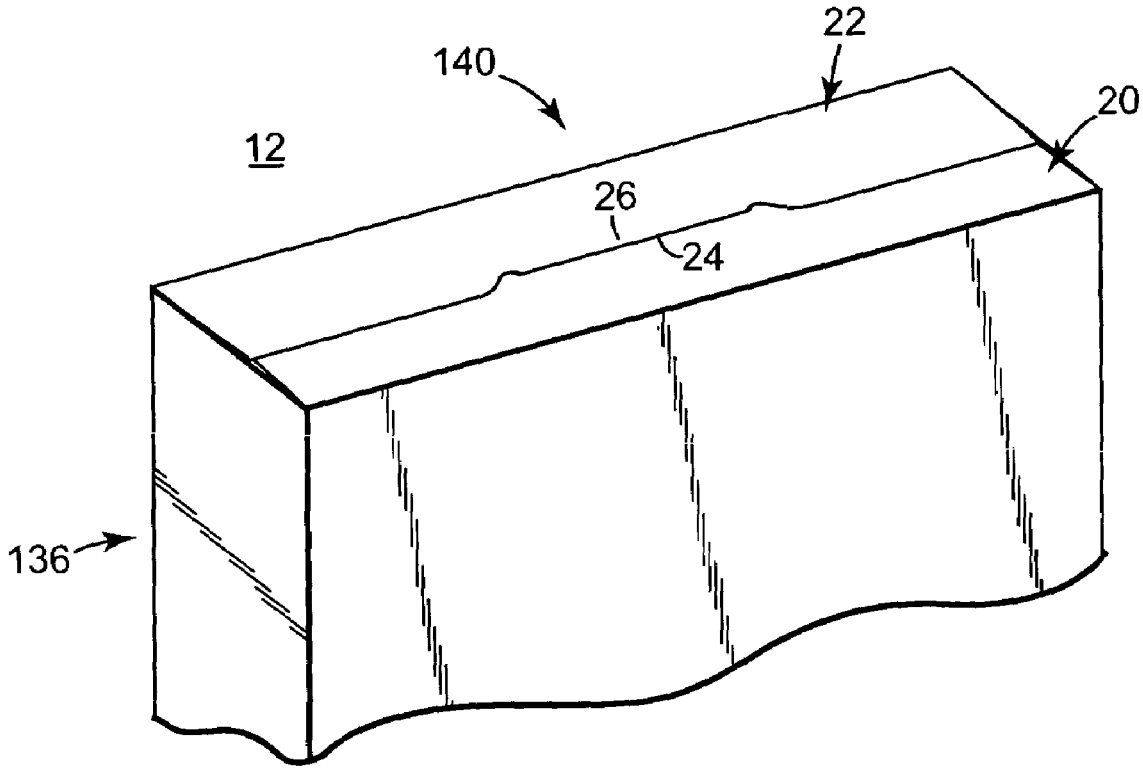
FIG. 4 is a partial perspective view of the carton of FIG. 2, illustrating a reclosed position.

Subsequent to opening of the carton 12, the carton 12 can be transitioned to a reclosed state as shown in FIG. 4. In this regard, the first and third partial flaps 70, 80 (FIG. 1) are first folded inwardly, on to the first and third partial flaps 70, 80. The first closure flap 20, that otherwise provides the tuck slot 24, is then folded inwardly on to the first closure flap 20. The second closure flap 22 is subsequently folded inwardly, with the tab 26 being inserted within the tuck slot 24. Notably, at no point during the opening or reclosing operations is the user (not shown) required to physically break or otherwise complete a perforation cut to complete the tuck slot 24. That is to say, the tuck slot 24 exists in a "completed" state immediately following initial assembly of the carton 12. Further, because the opening associated with the tuck slot 24 is relatively large, the tab 26 is easily inserted within the tuck slot 24 by simply pressing downwardly on the second closure flap 22 in a region of the tab 26. This downward force causes the first closure flap 20 to naturally deflect inwardly, thereby allowing the tab 26 to naturally nest within the tuck slot 24. This is in contrast to conventional perforation-type tuck slots in which the user must use both hands to manipulate the slot-defining closure flap into a proper position to receive the tab 26, an all-too-often cumbersome procedure. Further, because the tuck slot 24 of the present invention is pre-formed, a consistent ease of insertion is provided from carton-to-carton.

Figure 5:
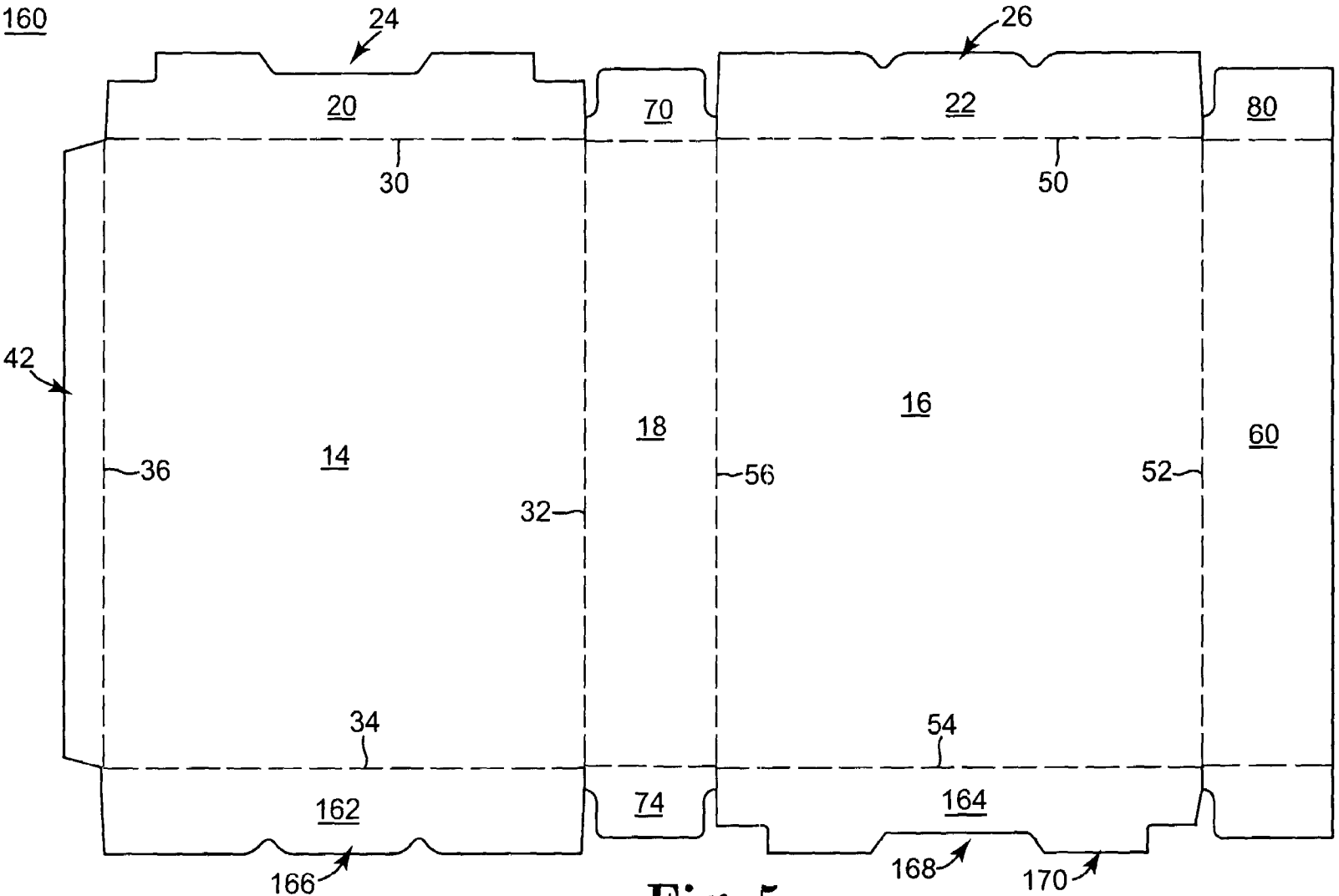
FIG. 5 is a plan view of an alternative blank for forming a carton in accordance with the present invention.

While the blank 10 (FIG. 1) and the resulting carton 12 have been described as providing the tuck slot 24/tab 26 configuration at only one end of the carton 12, in an alternative embodiment, multiple reclosure features in accordance with the present invention are provided. For example, FIG. 5 illustrates an alternative embodiment blank 160 highly similar to the blank 10 (FIG. 1) previously described. Thus, the blank 160 includes the first major panel 14, the second major panel 16, the first minor panel 18, the second minor panel 60, the first closure flap 20, and the second closure flap 22. In addition, the blank 160 of FIG. 5 includes a third closure flap 162 and a fourth closure flap 164. Unlike the third and fourth closure flaps 40, 60 (FIG. 1) of the previous embodiment, the third and fourth closure flaps 162, 164 are adapted to provide a tab 166 and a tuck slot 168, respectively, in accordance with the present invention. More particularly, the third closure flap 162 forms the tab 166 that is otherwise preferably identical to the tab 26 previously described. Similarly, the fourth closure flap 164 forms the tuck slot 168 that is otherwise preferably identical to the tuck slot 24 previously described. Alternatively, the tab 166 and/or the tuck slot 168 can vary from the tab 26 and/or tuck slot 24 previously described and otherwise provided with the blank 160. Regardless, the tuck slot 168 does not include a perforation cut, and is otherwise open relative to a leading edge 170 of the fourth closure flap 164. Further, the tuck slot 168 is adapted to selectively receive the tab 166 as part of a reclosure operation as previously described. In yet another alternative embodiment, the third closure flap 162 forms the tuck slot 168 whereas the fourth closure flap 164 forms the tab 166.

Figure 6:
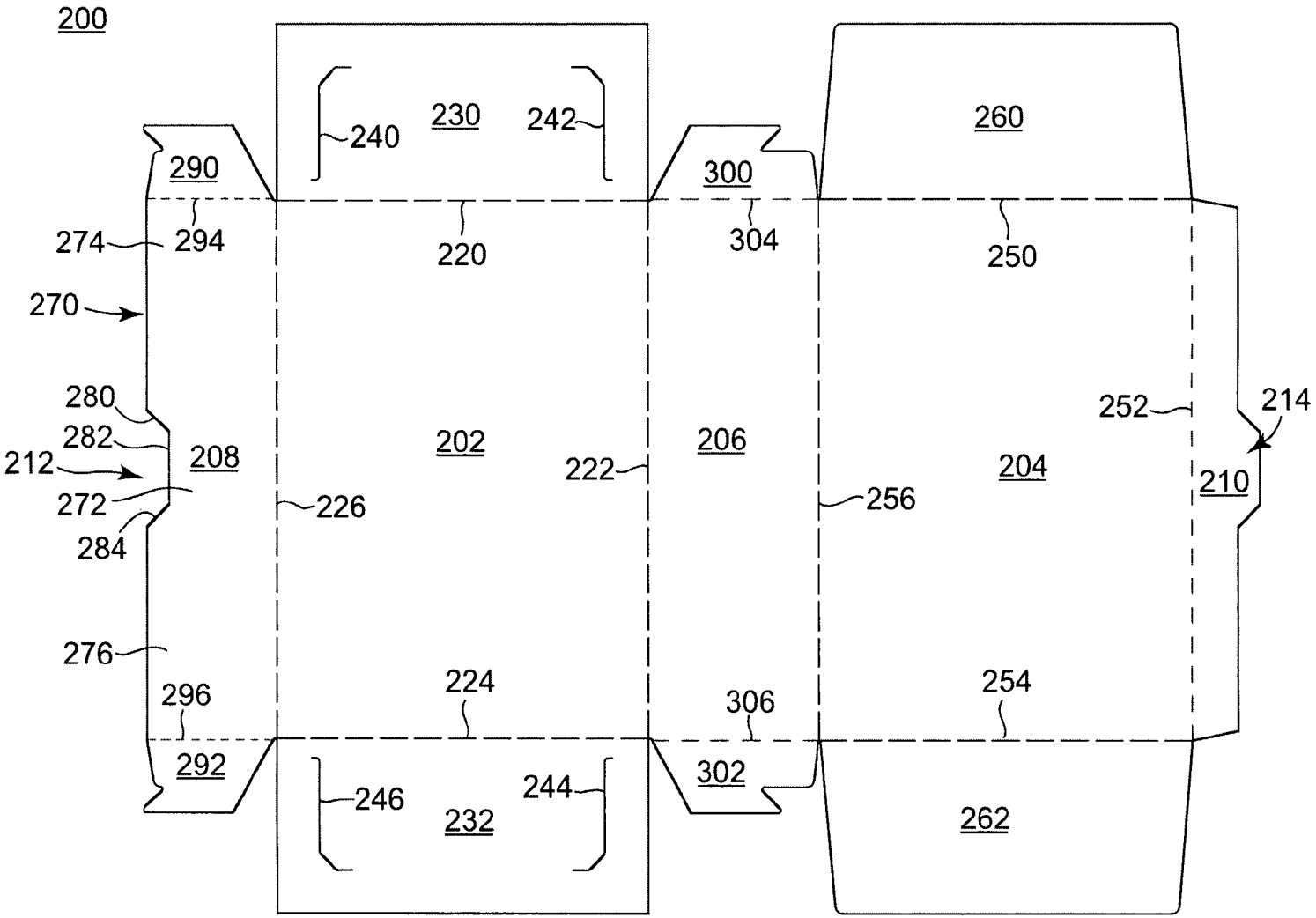
FIG. 6 is a plan view of another alternative embodiment blank for forming a carton in accordance with the present invention.

While the blanks 10, 160 have been described as providing a top-fill or bottom-fill configuration, alternative designs can also be employed that otherwise incorporate the reclosure feature of the present invention. For example, FIG. 6 illustrates an alternative embodiment blank 200 adapted to form a carton (not shown) in accordance with the present invention. The blank 200 includes a first major panel 202, a second major panel 204, a first minor panel 206, a first closure flap 208, and a second closure flap 210. The first closure flap 208 forms a tuck slot 212, whereas the second closure flap 210 forms a tab 214. Upon final assembly, the tuck slot 212 is adapted to receive the tab 214 as part of a reclosure operation.

As with previous embodiments, the first major panel 202 can assume a variety of shapes and sizes, and is preferably defined by first, second, third, and fourth ends or fold lines 220–226. The first minor panel 206 is connected to the first major panel 202 at the second fold line 222, whereas the first closure flap 208 is connected to the first major panel 202 at the fourth fold line 226. Further, a first side flap 230 is connected to the first major panel 202 at the first fold line 220, and a second side flap 232 is connected to the first major panel 202 at the third fold line 224. The first and second side flaps 230, 232 each include a pair of full cut slots 240, 242 and 244, 246, respectively. As described in greater detail below, the slots 240–246 are sized to selectively receive and maintain a corresponding locking flap.

Similarly, the second major panel 204 is defined by first, second, third, and fourth ends or fold lines 250–256. The first minor panel 206 is connected to the second major panel 204 at the fourth fold line 256, whereas the second closure flap 210 is connected to the second major panel 204 at the second fold line 252. Further, third and fourth side flaps 260, 262 are connected to the second major panel 204 at the first and third fold lines 250, 254, respectively.

As previously described, the first closure flap 208 forms the tuck slot 212. To this end, the first closure flap 208 extends from the first end or fold line 220 of the first major panel 202 to leading edge 270, and defines a central region 272, a first side region 274, and a second side region 276. The tuck slot 212 is formed by the leading edge 270 in the central region 272 that is otherwise preferably characterized by the absence of a perforation cut. Further, and as previously described, the tuck slot 212 is characterized by the absence of a perforation cut that would otherwise define a side or edge thereof. With this is mind, the tuck slot 212 is preferably similar to the tuck slot 24 (FIG. 1) previously described such that it is open relative to the leading edge 270. In this regard, the lead edge 270 defines a first section 280, a second section 282, and a third section 284 at the central region 272. The second section 282 is offset from the leading edge 270 at the first and second side regions 274, 276, and in one preferred embodiment, extends in a parallel fashion relative thereto. The first and third sections 280, 284 extend in an angular fashion from the second section 282, defining the taper angle $\alpha$ as previously described. Once again, the tuck slot 212 can assume a wide variety of other configurations, but preferably has a maximum length (i.e., maximum lateral distance between the first and third sections 280, 284) of at least 1 inch (25.4 mm).

With the embodiment of FIG. 6, first and second locking flaps 290, 292 extending from opposite sides of the first closure flap 208. In particular, the first and second locking flaps 290, 292 are connected to the first closure flap 208 along ends or fold lines 294, 296, respectively, such that the first and second locking flaps 290, 292 are foldable inwardly relative to the first closure flap 208. Similarly, third and fourth locking flaps 300, 302 are connected to, and extend from, the first minor panel 206, and are foldable relative thereto along ends or fold lines 304, 306, respectively.

Finally, and as previously described, the second closure flap 210 forms the tab 214. Once again, the tab 214 can assume a wide variety of forms, sized and shaped to be received within the tuck slot 212 as part of a reclosure operation.

Assembly of the blank 200 into a carton (not shown, but akin to the carton 12 of FIG. 2) is, with one technique commonly referred to as "side fill" or "side load", substantially as follows. The first and second locking flaps 290, 292 are folded inwardly relative to the first closure flap 208, and the first and second side flaps 230, 232 are folded inwardly relative to the first major panel 202. The first closure flap 208 is folded inwardly toward the first major panel 202, with the first locking flap 290 being inserted within the first slot 240 of the first side flap 230, and the second locking flap 292 being inserted within the second slot 246 of the second side flap 232. The third and fourth locking flaps 300, 302 are folded inwardly relative to the first minor panel 206. The first minor panel 206 is folded inwardly toward the first major panel 202, with the third locking flap 300 being inserted within the first slot 242 of the first side flap 230 and the fourth locking flap 302 being inserted within the first slot 244 of the second side flap 232. With this configuration, then, the first and third locking flaps 290, 300 are secured to the first side flap 230, and the second and fourth locking flaps 292, 302 are secured to the second side flap 232. At this point, product(s) (not shown) can be placed into the partially formed carton before closing the second major panel 204.

After filling, the second major panel 204 is folded inwardly toward the first major panel 202. The second closure flap 210 is then folded inwardly onto of-the first closure flap 208 and adhered thereto. The third and fourth side flaps 260, 262 are folded inwardly relative to the second major panel 204 and adhered (such as via glue) to the first and second side flaps 230, 232, respectively.

Upon final assembly, the resultant carton (not shown) formed by the blank 200 is similar to the carton 12 (FIG. 1) previously described, having a top closure (not shown) that includes the first and second closure flaps 208, 210, and in particular the tab 214 and the fully-formed tuck slot 212. To open the carton, the first and second closure flaps 208, 210 are separated from one another. As part of a closure operation, the second closure flap 210 is directed on to the first closure flap 208 such that the tab 214 nests within the tuck slot 212.

The blank and carton of the present invention provides a marked improvement over previous designs. In particular, by providing a pre-formed tuck slot having a relatively large opening with no corresponding perforations, a user can easily make use of the reclosure feature. That is to say, the user is not required to break or otherwise push through a perforation cut, an activity that often times causes frustration and/or packaging damage. For example, while the carton has been shown as assuming a generally rectangular shape, a wide variety of other shapes are equally acceptable, as are any desired size/volume.

Although the present invention has been described with reference to preferred embodiments, workers skilled in the art will recognize that changes can be made in form and detail without departing from spirit and scope of the present invention. For example, while the carton has been shown as assuming a generally rectangular shape, a wide variety of other shapes are equally acceptable, as are any desired size/volume.

What is claimed is:

1. A blank for forming a carton, the blank comprising:

a first major panel;

a second major panel;

a first minor panel connected between the first and second major panels;

a first closure flap connected to a first end of the first major panel and extending therefrom to a leading edge, the first closure flap including a central region forming a tuck slot that extends to and is open relative to the leading edge, the central region defining a first, a second, and a third section, the leading edge at the first and third sections tapering at a taper angle to the second section such that the second section defines a minimum width of the tuck slot; and a second closure flap extending from a first end of the second major panel, the second closure flap forming a tab including opposing side portions tapering at a taper angle to a central portion;

wherein the taper angle of the tuck slot is greater than the taper angle of the tab such that the tuck slot is adapted to selectively receive the tab in a carton formed by the blank.

2. The blank of claim 1, wherein at least the central region of the first closure flap is characterized by the absence of a perforation cut.

3. The blank of claim 1, wherein the tuck slot is characterized as not being defined by a perforation cut.

4. The blank of claim 1, wherein the first closure flap further includes first and second side regions at opposite sides of the central region, respectively, and further wherein a maximum linear extension of each of the side regions adjacent the tuck slot relative to the first end of the first major panel is greater than a majority of a linear extension of the central region.

5. The blank of claim 4, wherein at least a portion of the leading edge at the central region is not aligned with the leading edge at the first side region.

6. The blank of claim 4, wherein the first section extends from the first side region, the second section extends from the first section, and the third section extends from the second section to the second side region, and further wherein the first section extends from the second section in an angular fashion in a plane of the blank.

7. The blank of claim 6, wherein extension of the first section from the second section defines a taper angle in the range of 40°–70°.

8. The blank of claim 6, wherein the third section extends from the second section in an angular fashion in a plane of the blank.

9. The blank of claim 6, wherein relative to the first end of the first major panel, the first section extends inwardly from the first side region to the second section, and the third section extends inwardly from the second side region to the second section.

10. The blank of claim 6, wherein the leading edge at the second section is off-set from the leading edge at the first and second side regions in a plane of the blank.

11. The blank of claim 4, wherein at least a portion of the leading edge at the first side region is aligned with at least a portion of the leading edge at the second side region and is not aligned with the leading edge at the central region.

12. The blank of claim 1, wherein the tuck slot defines an opening having an area of at least $0.5^2$ inch.

13. The blank of claim 1, wherein the tuck slot has a longitudinal width in a plane of the blank of at least 0.125 inch.

14. The blank of claim 1, further comprising:

a third closure flap extending from an end of the first major panel opposite the first closure flap; and a fourth closure flap extending from an end of the second major panel opposite the second closure flap;

wherein one of the third and fourth closure flaps forms a second tuck slot that is open relative to a leading edge thereof and an other of the third and fourth closure flaps forms a second tab;

further wherein the second tuck slot is adapted to receive the second tab in a carton formed by the blank.

15. The blank of claim 1, wherein the first and second major panels are arranged such that the first end of the first major panel is generally aligned with the first end of the second major panel in a plane of the blank.

16. The blank of claim 15, further comprising:

a glue flap connected to the first major panel opposite the first minor panel; and a second minor panel connected to the second major panel opposite the first minor panel.

17. The blank of claim 15, further comprising:

a second minor panel connected to the first major panel opposite the first minor panel; and a glue flap connected to the second major panel opposite the first minor panel.

18. The blank of claim 1, wherein the first and second major panels are arranged such that the first end of the first major panel is generally parallel to, but not aligned with, the first end of the second major panel in a plane of the blank.

19. The blank of claim 18, further comprising:

first and second side flaps extending from opposite ends of the first major panel, respectively, in a perpendicular fashion relative to an extension of the first closure flap in a plane of the blank; and third and fourth side flaps extending from opposite ends of the second major panel, respectively, in a perpendicular fashion, relative to an extension of the second closure flap in a plane of the blank.

20. A carton comprising:

a front wall;

a back wall;

opposing side walls connecting opposite sides of the front and back walls, respectively, to define a tubular structure having a top and a bottom;

a bottom closure provided at the bottom of the tubular structure; and a top closure provided at the top of the tubular structure, the top closure including:

a first closure flap extending to a leading edge and including a central region forming a tuck slot that extends to and is open relative to the leading edge, the central region defining first, second, and third sections, the leading edge at the first and third sections tapering at a taper angle to the second section such that the second section defines a minimum width of the tuck slot, and a second closure flap forming a tab including opposing side portions tapering at a taper angle to a central portion, the taper angle of the tuck slot being greater than the taper angle of the tab;

wherein the top closure is configured such that the tuck slot selectively receives the tab as part of a reclosure operation.

21. The carton of claim 20, wherein at least the central region of the first closure flap is characterized by the absence of a perforation cut.

22. The carton of claim 20, wherein the tuck slot is characterized as not be defined by a perforation cut.

23. The carton of claim 20, wherein an extension of the first section relative to the second section and an extension of the third section relative to the second section each defines a taper angle greater than 30° in a plane of the first closure flap.

24. The carton of claim 20, wherein the first closure flap is connected to the front wall, and the second closure flap is connected to the back wall.

25. The carton of claim 20, wherein the first closure flap is connected to the back wall, and the second closure flap is connected to the front wall.

26. The carton of claim 20, wherein the bottom closure includes:

a third closure flap extending to a leading edge and including a central region forming a second tuck slot that is open relative to the leading edge of the third closure flap;

a fourth closure flap forming a tab;

wherein the bottom closure is configured such that the second tuck slot selectively receives the second tab as part of a reclosure operation.

27. The carton of claim 20, wherein a maximum width of the tuck slot is greater than a maximum width of the tab.

* * * * *